United States Patent [19]

Spangenberg

[11] Patent Number: 4,685,502

[45] Date of Patent: Aug. 11, 1987

[54] MULTIPLE-GLAZED WINDOW ASSEMBLY

[75] Inventor: Robbert E. Spangenberg, Oosterhout, Netherlands

[73] Assignee: Hunter Douglas International N.V., Curacao, Netherlands Antilles

[21] Appl. No.: 797,576

[22] Filed: Nov. 13, 1985

[30] Foreign Application Priority Data

Apr. 26, 1985 [EP] European Pat. Off. ..... 85302994.0

[51] Int. Cl.[4] ..... E06B 3/32

[52] U.S. Cl. ..... 160/107; 160/176 R

[58] Field of Search ..... 160/107, 174, 176 R

[56] References Cited

U.S. PATENT DOCUMENTS 4,456,049 6/1984 Vecchiavelli ..... 160/176 R
4,459,778 7/1984 Ball ..... 160/107 X
4,484,611 11/1984 Anderson ..... 160/107
4,588,012 5/1986 Anderson ..... 160/107 X

FOREIGN PATENT DOCUMENTS 1066909 7/1954 Fed. Rep. of Germany ..... 160/176
680028 6/1965 Italy ..... 160/107

*Primary Examiner*—Robert W. Gibson, Jr.
*Attorney, Agent, or Firm*—Pennie & Edmonds

[57] ABSTRACT

A multiple-glazed window assembly is described in which a tilting mechanism unit (40) is secured to one side frame member (10). A venetian blind assembly including upper and lower supporting members (31, 32) is mounted on carriers (14,15) carried by the upper and lower frame members (12,13) by snap-fit pivotal securing elements (25) and connecting means (75) on the upper and lower supporting elements (31,32) are advanced to engage connecting means (58) on the tilting mechanism unit (40).

26 Claims, 10 Drawing Figures

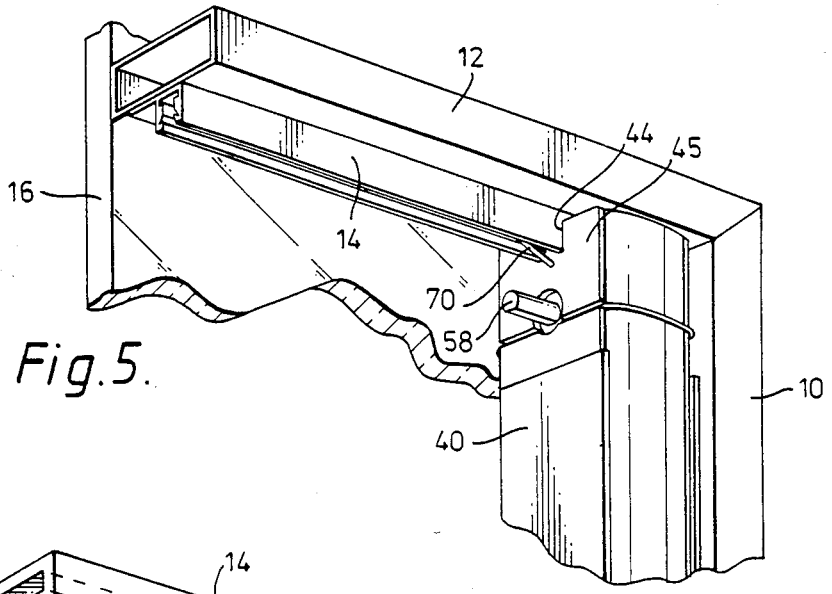
Fig.5.
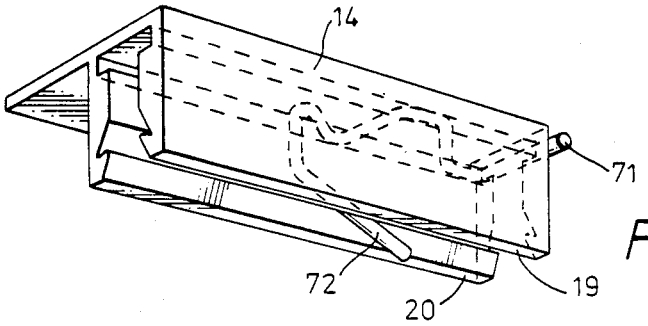
Fig.6.
Fig.7.
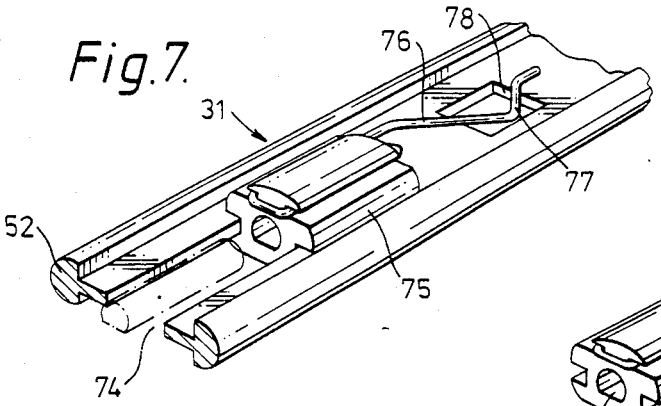
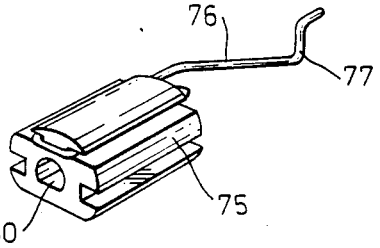
Fig.8.

MULTIPLE-GLAZED WINDOW ASSEMBLY

The present invention relates to venetian blinds to be mounted between two panes of glass of a multiple glazed window.

There have been many proposals for mounting a venetian blind in such a way between two panes of glass of a double, triple or multiple glazed window. Some of these proposals have involved the use of cords which pass through the frame of the window to cause the slats of the venetian blind to be tilted and others have involved the use of a magnetic control with one magnet mounted inside the space between the two panes and the other magnet mounted outside the pane, usually in the interior of the room in which the window is fitted.

However, most of these arrangements have involved a relatively complex assembly operation as a result of which there has been little or no commercial exploitation of the multiple glazed window unit with a venetian blind located between two panes.

Starting from the concept of the use of a blind which comprises an upper elongate supporting member extending across all or part of the width of the blind, means for pivotally mounting the supporting member about its longitudinal axis, slat supporting means, usually in the form of cords or tapes, extending from said upper supporting member and a plurality of slats carried by said supporting means, it is now proposed, according to the present invention, to provide a slat tilting mechanism unit which is separate from the blind and includes an elongate body securable against the inner surface of the side frame member of the frame of the multi-glazed window, by holding means, a bearing on said body, adjacent one end of the body, a rotat-able drive member mounted in said bearing, an operating member linearly movable longitudinally of said body by the magnetic effect of a linearly movable actuating member mounted externally of the multiple glazed window, a drive element connected between said operating element and said rotational drive member, whereby movement of said operating member will cause simultaneous rotation of said drive member in the same rotational sense, and a connection on said rotational drive member drivingly connectable to one end of the upper elongate supporting member.

With such an arrangement, the slat tilting mechanism can be manufactured separately and all that is then necessary to do is to mount, during the window assembly operation, the tilting mechanism against the side frame member of the preformed frame, to introduce the venetian blind into the interior of the frame to engage the connecting means of the upper elongate support member with the drive member of the tilting mechanism, pivotally mount the upper support member on the upper frame member and subsequently apply one or both of the panes of the glass to the rectangular frame.

Thus, according to another aspect of the present invention, there is provided a method of mounting a tiltable venetian blind between two panes of a multiple glazed window having a rectangular frame with upper and lower frame members and side frame members, said method comprising the steps of mounting during the window assembly operation, a separate venetian blind tilting mechanism unit against one of the window frame side members, positioning holding means to hold the unit fixedly in close contact with said side member, mounting a pre-assembled venetian blind mat assembly comprising mat support members, slat supporting means, a plurality of slats and connecting means, to at least the upper one of the upper and lower frame members, and coupling the mat assembly to the tilting mechanism unit by interconnecting them with the connecting means and in a manner in which activating the tilting mechanism from outside the window will result in the tilting of the slats.

With such a method, if the actuating of the tilting mechanism is obtained by using magnetic means, after mounting the panes on the window side from which the tilting mechanism is to be activated, an actuating member may be mounted on the outside of said pane at a location of the tilter mechanism unit in a position to be linearly movable along the pane surface to operate the tilting mechanism to tilt the slats.

Preferably, the venetian blind slat assembly is also pivotally connected to the lower frame member and a lower elongate support member is engaged with a lower drive member forming part of the tilting mechanism.

Preferably, therefore, as far as the slat tilting mechanism unit is concerned, the blind further comprises a lower elongate supporting member and the supporting means extend between said upper and lower supporting members, and the unit has two spaced parallel bearings, one adjacent each end of the body, a second rotatable drive member being mounted in the other of said bearings, and the connection is provided between the second rotatable drive member and the lower elongate support member.

While the elongate body may take many forms, preferably it comprises a hollow section housing, for example, a channel section housing, with an end plug inserted in at least one end of the hollow section body, the end plug or plugs having said bearing or bearings mounted therein.

The assembly of the tilting mechanism unit can be facilitated by the or each end plug consisting of two parts, each part having a bearing therein, the associated rotatable drive member being mounted between the two parts of the or each end plug.

In a convenient construction, the drive element is a flexible metal drive band, the drive member or members are provided with an at least part-circular surface over which said flexible element passes, the flexible metal band is provided with at least one aperture or projection on a portion thereof, passing over each at least part-circular surface, said surface being provided with projections or recesses to engage with said aperture or projections respectively, to positively engage the flexible drive element on said at least part-circular surface.

The invention also relates to a venetian blind assembly comprising a slat tilting mechanism unit of the invention, an upper elongate supporting member extending across all or part of the width of the blind, means for pivotally mounting the supporting member about its longitudinal axis, slat supporting means extending between the upper and lower support members, a plurality of slats carried by said supporting means and connecting means on said upper elongate supporting member, at one end thereof, engaged with the connection of the associated drive member.

In order to facilitate the interconnection of the elongate supporting members with the drive members, the connecting means preferably include a longitudinally slidable block on the or each supporting member and means to couple said blocks directly to the connection of the respective rotatable drive member, so as to be rotatable thereby, upon movement of said slide blocks from the retracted position to an advanced position, said coupling means being a non-circular hole engaged by correspondingly non-circular stub shaft of the drive member. In order satisfactorily to position the block before and after assembly in the frame, a releasable latch is desirably provided to hold said sliding block selectively in said advanced or said retracted position.

The means for pivotally mounting the upper and/or lower supporting member may comprise bearing clips, said bearing clips each including a pivot bearing for the respective supporting member and a securing element which is engageable by a snap-fit connection in the receiving portion of the carrier securable to, integral with, or forming the respective and/or lower frame of the multiple glazed window.

In this case, the carrier preferably comprises an elongate profile of constant cross-section having a continuous receiving channel with at least one inturned rim and into which said securing element may be pushed, the head of said securing elements snap-fitting behind said rims.

While the holding means for the tilting mechanism unit may comprise simply screws or adhesive, conveniently they comprise a resilient element which permits the body to be pushed into engagement with a side frame member and then spring back to retain the body in that position. The resilient member may, for example, comprise a spring clip mounted at the end of the carrier carried by the upper and/or lower frame member, said spring clip having a portion which is pushed away as the body is moved towards the side frame member and springs back to hold the body in engagement with the side frame member.

In order that the invention may more readily be understood, the following description is given, merely by way of example, reference being made to the accompanying drawings, in which:

FIG. 5 is a fragmentary perspective view of a corner of the window with the tilting mechanism unit secured in place;

FIG. 6 is a fragmentary perspective view of a part of the upper carrier profile illustrating a clip for retaining the tilter mechanism unit in place;

FIG. 7 is a perspective view of the end of the upper support member showing the the connecting means thereof in a retracted position;

FIG. 8 is a perspective view of the connecting means itself;

Figure 1:
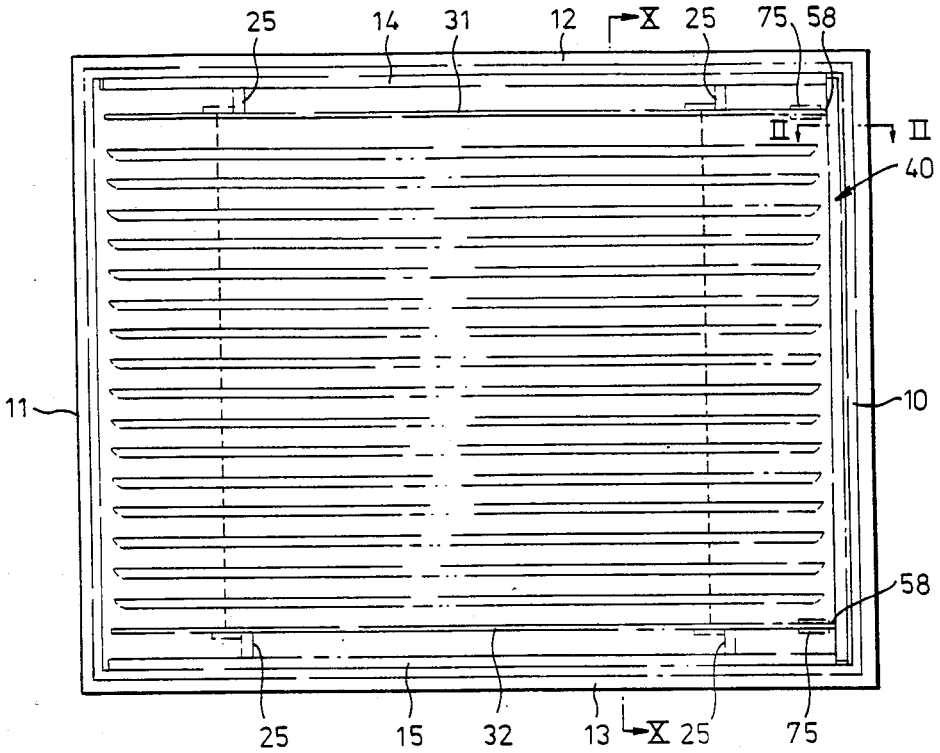
FIG. 1 is a schematic front elevation of one embodiment of multiple glazed window assembly unit according to the present invention.
Figure 10:
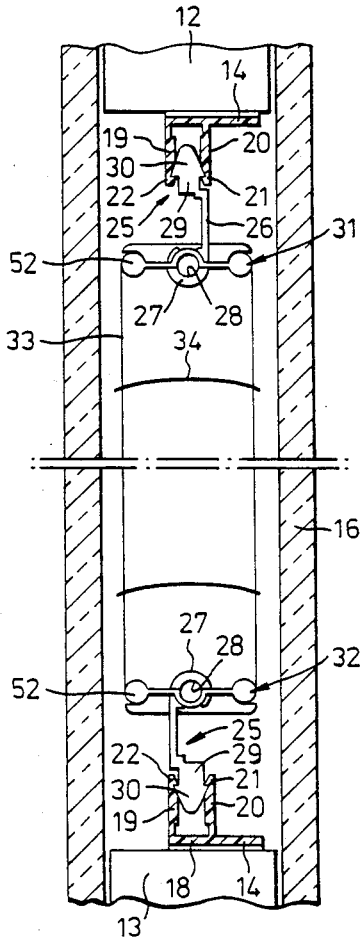
FIG. 10 is an enlarged cross-section taken along the line X—X of FIG. 1 with the blind in the opened position.

Referring first to FIGS. 1 and 10 of the drawings, there is illustrated a double glazed window having two side frame members 10, 11 and upper and lower frame members 12, 13. Secured to the upper and lower frame members are carriers 14 and 15 respectively. The frame members 10 to 13 carry outer and inner panes 16, 17.

It will be noted from FIG. 10 that the carriers 14, 15 include a web 18 and two flanges 19, 20 which form with a part of the web, a channel cross-section profile. The edges of the flange 19, 20 are provided with inturned rims 21, 22.

Engaged into the chanel sections of the carriers 14, 15 are pivotal securing elements 25. They consist of a hook-shaped body portion 26 with a bearing portion 27 having a throughbore 28. At the other end of the body is a neck 29 beyond which is an enlarged head 30. It can be seen that the head 30 can be pressed up, as a push fit, between the flanges 19, 20, so that the rims 21, 22 engage under the head 30 at the location of the neck 29, to hold the securing elements 25 in the carriers 14, 15.

A venetian blind is fitted between the panes 16, 17 and includes an upper supporting member 31 and a lower supporting member 32, which are of a similar construction to a venetian blind slat, but rather more robust, having ribs 52 extending along each longitudinal edge.

Between these upper and lower supporting members extend slat supporting means in the form of ladder tapes 33 and on which are mounted conventional slats 34.

The upper and lower supporting members are carried by the securing elements 25 and for this purpose the securing elements are provided in a number of places as can be seen in particular in FIG. 1.

Figure 2:
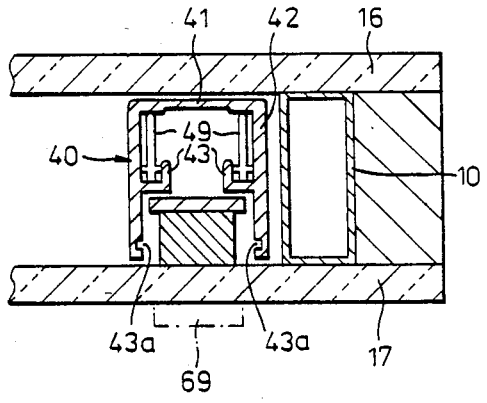
FIG. 2 is an enlarged fragmentary cross-section taken along the line II—II of FIG. 1.
Figure 3:
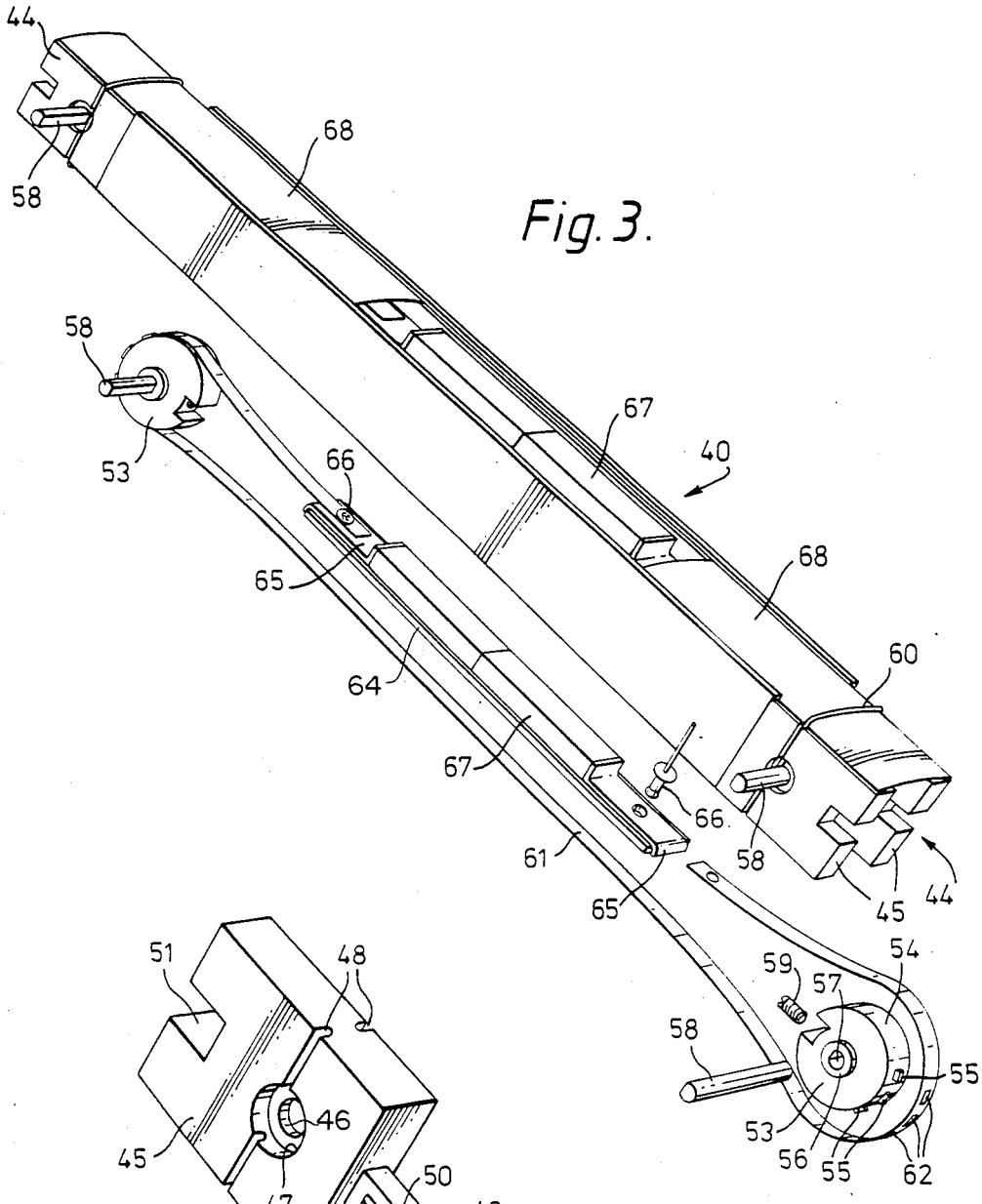
FIG. 3 is an enlarged schematic perspective view of one embodiment of tilting mechanism according to the invention.
Figure 4:
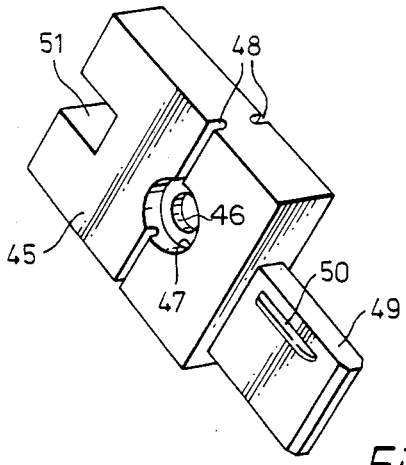
FIG. 4 is a further enlarged view of one part of one of the end plugs of the mechanism unit of FIG. 3.

If reference is now made to FIGS. 2 and 3 of the drawings, it will be seen that the side frame member 10 has secured thereto a tilting mechanism unit indicated by the general reference numeral 40. This is of a generally channelsection including a web 41 and side flanges 42, each carrying an inwardly turned L-shaped ledge 43. Adjacent the free ends of the side flanges 42 are grooves 43*a*. Pressed into the open ends of the channel section body of unit 40 are end plugs 44, each consisting of two equal plug parts 45, as illustrated in greater detail in FIG. 4. These plug parts each include a main body having a bearing aperture 46 countersunk at 47 with a transverse groove 48 on each side. Extending from one end is a longitudinally extending tongue 49 having a rib 50 thereon, the tongue being offset from the longitudinal centre line of the plug part 45. Adjacent the other end is a recess 51.

In order to assemble the plug parts, the tongues 49 are pressed into an end of the body of unit 40 and are engaged between the web 41 and the L-shaped ledges 43 as seen in FIG. 2.

Mounted between the bearing parts are drive members 53 having an at least partly circular periphery 54 with a number (three as illustrated) of radially outwardly extending projections 55. The drive members 54 have a hub 56 with a non-circular cross-section bore 57 into which can be inserted connecting means in the form of a similarly non-circular cross-section stub shaft 58, which can be secured in the drive member 53 by a grub screw 59. With a plug part 45 on each face of the drive member 53, the two plug parts can be inserted as described above, the hubs 56 then engaging in the counterbores 47. Rotation of the drive member during transport can be prevented by using a clip 60 engaging in the grooves 48.

Passed over the part-circular periphery 54 of the drive members 53 is a flexible metal drive element 61 provided with apertures 62 to engage over the projections 55 to provide a positive drive connection between the drive element 61 and the drive members 53.

A metal magnet support 64 having end plates 65 is secured to the drive element 61, rivets 66 passing through apertures in the end plate 65 and apertures adjacent the ends of the drive element 61. The magnet support has on its upper surface two magnets 67 which project outwardly of the free ends of the side flanges 42 of the body 40. The magnets are held on support 64 by their magnetism and positioned by end plates 65. Covers 68 have their side edges engaged in the grooves 43*a* and are held in place by the clips 60.

The magnet assembly 64–67 can be considered as an operating element for causing the drive members 53 to rotate and an actuating element indicated in phantom at 69 in FIG. 2, is mounted outside the pane 17, so that linear movement of the actuating element 69 will cause linear movement of the operating member 64–67 and thus rotation of the drive members 53.

The tilting mechanism unit 40 can be secured to the side frame member 10, for example by adhesive, by screws or preferably by a clip arrangement which can be seen more clearly in FIG. 5. In this Figure there can be seen the frame member 12 and its carrier 14. If the unit 40 is engaged in the frame and moved to the right, then the recesses 44 accommodate the carriers 14. A clip 70, which is illustrated in more detail in FIG. 6, has a first arm 71 extending beyond the end of the carrier 14 and a second resilient downwardly extending arm 72 which extends below the lower edges of the side flanges 19, 20 of the carrier 14. Thus, as the unit 40 is pushed to the right the arm 72 will first flex upwardly and it will then spring downwardly so that its free end engages the plug part 45 to hold the unit 40 in place. A similar arrangement is provided at the lower carrier 15.

Figure 9:
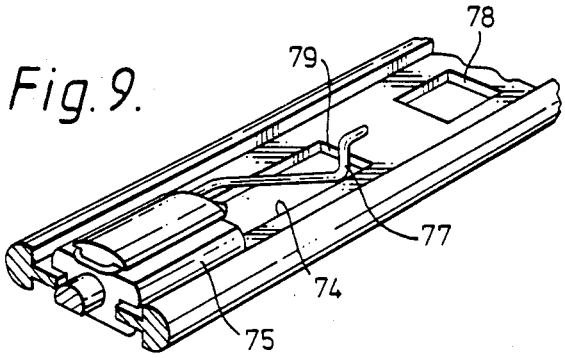
FIG. 9 is a view similar to FIG. 7 with the connecting means in the advanced positon.

If reference is now made to FIG. 7, it will be seen that the end of the supporting element 31 is provided with an elongate notch 74 having longitudinally slidable therein, a block 75 to which is attached a latch 76 having a portion 77 engageable in an opening 78 in the supporting element 31. The latch thus holds the block in a retracted position. The block can also be moved to the advanced position illustrated in FIG. 9 in which the latch portion 77 engages the end 79 of the notch 74. A similar arrangement may be provided at the lower supporting element 32.

In order to manufacture the window assembly as shown in the drawings, the frame formed by the members 10 to 13 is formed first with the upper and lower carriers 14, and 15. At this stage one can mount the first glazing 16 and then position the clips 70 in these carriers. The tilting mechanism unit 40 is then mounted as described above so that the clips 70 hold it in place.

A mat of venetian blind slats including the upper and lower supporting elements 31, 32 with the associated pivotal securing elements 25 are then positioned in the blind with the connecting means in the form of a slidable blocks 75 in the retracted position as shown in FIG. 7. The pivotal securing elements 25 are snap-fitted into the carriers 14, 15 and the slidable blocks 75 of the connecting means are moved to the advanced position so that non-circular bores 80 in the ends of the block can engage over the connections to the drive members 53 provided by the stub shafts 58. The second pane 17 can then be secured in position in the conventional way and an actuating element 69 can be mounted by means (not shown) on the window assembly to allow for vertical movement thereof. This vertical movement will cause vertical movement of the magnet 64–67 and thus rotation of the drive members 53 which in turn will cause rotational pivoting of the supporting members 31, 32 and thereby tilting of the slats of the blind.

It will be appreciated that the construction of the present invention greatly facilitates the manufacture of the window assembly with its inbuilt venetian blind since the actual assembly of the venetian blind into the window involves only the positioning of the clips 70, the insertion of the tilting mechanism unit 40, the positioning of the venetian blind and then the longitudinal movement of the blocks 75.

I claim:

1. A slat tilting mechanism unit for use in mounting a venetian blind in a mounted position between two panes of glass (16, 17) of a multiple glazed window forming an opening to be covered by said blind, in which the blind comprises an upper elongate supporting member (31) extending across all or part of the width of the blind, means (25) for pivotally mounting the supporting member about its logitudinal axis, slat supporting means (33) extending from said upper supporting member (31) and a plurality of slats (34) having slat ends carried by said supporting means (33), said slat tilting mechanism unit being characterised in that it is separate from the blind and includes an elongate body (40) positionable at a side of the opening to be covered by the blind, so as to confront the slat ends at one side of the mounted position of the blind, a bearing (46) on said body (4), adjacent one end of the body, a rotatable drive member (53) mounted in said bearing (46), an operating member (64–67) linearly movable longitudinally of said body under magnetic effect by a linearly movable actuating member (69) mounted externally of the multiple glazed window, a drive element (61) connected between said operating member and said rotatable drive member (53), whereby linear movement of said opertaing member (64–67) will cause simultaneous rotation of said drive member (53) in the same rotational sense, a connection (57, 58) on said rotatable drive member (53) drivingly connectable, to one end of the upper elongate supporting member (31).

2. A mechanism unit according to claim 1, wherein the blind further comprises a lower elongate supporting member (32) and the supporting means (33) extend between said upper and lower supporting members (31,32), characterised in that the unit (40) has two spaced parallel bearings (46), one adjacent each end of the body, a second rotatable drive member (53) mounted in the other of said bearings (46) and in that a connection (57,58) is provided between the second rotatable drive member (53) and the lower elongate supporting member (32).

3. A mechanism unit according to claim 1, characterised in that the elongate body (40) comprises a hollow section housing, with an end plug (44) inserted in at least one end of said hollow section body, the end plug (44) having said bearing (46) mounted therein.

4. A mechanism unit according to claim 3, characterised in that said at least one end plug (44) consists of two parts (45), each having a bearing (46) therein, the associated rotatable drive member (53) being mounted between the two parts of the at least one end plug.

5. A mechanism unit according to any preceding claim, characterised in that said drive element (61) is a flexible metal drive band, in that the drive member or members (53) are provided with an at least part circular surface (54) over which said flexible element (61) passes and in that the flexible metal band is provided with at least one aperture (62) or projection on a portion thereof, passing over each at least partly circular surface (54), said surface being provided with projections (55) or recesses to engage with said aperture (62) or projections respectively.

6. A venetian blind assembly comprising a slat tilting mechanism unit according to any one of the claims 1–4, 5 or 4, an upper elongate supporting member (31,32) extending across all or part of the widths of the blind, means (25) for pivotally mounting the supporting members about their longitudinal axes, slat supporting means (33) extending from said upper support member, as plurality of slats (34) carried by said supporting means, and connecting means (75,80) on said upper elongate supporting member (31,32), at one end thereof, releasably engageable with the connection (57,58) of the associated drive member (53).

7. A venetian blind assembly according to claim 6, wherein the blind further comprises a lower elongate supporting member (32) and the supporting means (33) extend between said upper and lower supporting members (31,32), characterised in that the unit (40) has two spaced parallel bearings (46), one adjacent each end of the body, a second rotatable drive member (53) mounted in the other of said bearings (46) and in that a connection (57,58) is provided between the second rotatable drive member (53) and the lower elongate supporting member (32).

8. A venetian blind assembly according to claim 6, characterised in that said connecting means includes a longitudinally slidable block (75) on the or each supporting member (31,32), and a means (58) to couple said block directly to the connection (57) of the respective rotatable drive member so as to be rotatable thereby, upon movement of said slide blocks (75) from a retracted position to an advanced position, said coupling means being a non-circular hole (80) engaged by a correspondingly non-circular stub shaft (58) of the drive member (53).

9. A venetian blind assembly according to claim 8, characterised in that a releasable latch (76-79) is provided to hold said sliding block (75) selectively in said advanced position.

10. A venetian blind assembly according to claim 6, characterized in that the means for pivotally mounting at least one of the upper and the lower supporting member comprise bearing clips (25), said bearing clips (25) each including a pivot bearing (27,28) for the respective supporting member and a securing element (3) which is engageable by a snap-fit connection in a receiving portion of a carrier (14,15) securable to the respective frame (12,13) of the multiglazed window.

11. A venetian blind assembly according to claim 10, characterised in that said carrier (14,15) comprises an elongate profile of constant cross-section having a continuous receiving channel (18,19,20) with at least one inturned rim (21,22) and into which said securing element may be pushed, the head (30) of said securing element snapfitting behind said rims (21, 22).

12. A venetian blind assembly according to claim 6, characterised in that the holding means (70) comprises a resilient element which permits the body (40) to be pushed into engagement with a side frame member (10) and then springs back to retain the body in that position.

13. A venetian blind assembly according to claim 12, characterized in that the resilient element (70) comprises a spring clip mounted at the end of a carrier (14,15) securable to and integral with at least one of the upper and lower frame member (12,13), said spring clip having a portion (72) which is pushed away as the body (40) is moved towards the side frame member (10) and springs back to hold the body in engagement with side frame member (10).

14. A method of mounting a tiltable venetian blind between two panes of a multiple glazed window having a rectangular frame with upper and lower frame members and side frame members, characterised in that it comprises the steps of mounting during the window assembly operation, a separate venetian blind tilting mechanism unit against one of the window frame side members, positioning holding means to hold the unit fixedly in close contact with said side member, mounting a pre-assembled venetian blind slat assembly comprising slat support members, slat supporting means, a plurality of slats and connecting means, to at least the upper-one of the upper and lower frame members, and coupling the slat assembly to the tilting mechanism unit by interconnecting them with the connecting means and in a manner in which activating the tilting mechanism from outside the window will result in the tilting of the slats.

15. A method according to claim 14, wherein the actuating of the tilting mechanism is obtained by use of magnetic means, characterised in that after mounting the panes at the window side from which the tilting mechanism is to be activated, an actuating member is mounted on the outside of said pane at the location of the tilter mechanism unit in a position to be linearly movable along the pane surface to operate said tilting mechanism to tilt the slats.

16. A method according to claim 14 or 15, characterised in that the venetian blind slat assembly is also coupled to the lower frame member.

17. A mechanism unit according to claim 2, characterized in that the elongate body (40) comrpises a hollow section housing, with an end plug (44) inserted in at least one end of said hollow section body, and end plug (44) having said bearing (46) mounted therein.

18. A mechanism unit according to claim 17, characterized in that said at least one end plug (44) consists of two parts (45), each having a bearing (46) therein, the associated rotatable drive member (53) being mounted between the two parts of the at least one end plug.

19. A venetian blind assembly comprising a slat tilting mechanism unit according to claim 5, an upper elongate supporting member (31,32) extending across all or part of the width of the blind, means (25) for pivotally mounting the supporting members about their longitudinal axes, slat supporting means (33) extending from said upper support member, a pluality of slats (34) carried by said supporting means, and connecting means (75,80) on said upper elongate supporting member (31,32) at one end thereof, releasably engageable with the connection (57,58) of the associated drive member (53).

20. A venetian blind assembly according to claim 19, wherein the blind further comprises a lower elongate supporting member (32) and the supporting means (33) extend between said upper and lower supporting members 931,32), characterized in that the unit (40) has two spaced parallel bearings (46), one adjacent each end of the body, a second rotatable drive member (53) mounted in the other of said bearings (46) and in that a connection (57,58) is provided between the second rotatable drive member (53) and the lower elongated supporting member (32).

21. a venetian blind assembly according to claim 8, characterized in that a releasable latch (76–79) is provided to hold said slighting block (75) selectively in said retracted position.

22. A ventian blind assembly according to claim 21, characterized in that the means for pivotally mounting at least one of the upper and the lower supporting member comprise bearing clips (25), said bearing clips (25) each including a pivot bearing (27,28) for the respective supporting member and a securing element (3) which is engageable by a snap-fit connection in a receiving portion of a carrier (14,15) integral with the respective frame (12,13) of the multiglazed window.

23. A venetian blind assembly according to clsaim 21, characterized in that the means for pivotally mounting at least one of the upper and the lower supporting member comprise bearing clips (25), said bearing clips (25) each including a pivot bearing (27,28) for the respective supporting member and a securing element (3) which is engageable by a snap-fit connection in a receiving portion of a carrier (14,15) forming the respective frame (12,13) of the multiglazed window.

24. A venetian blind assembly according to claim 12, characterized in that the resilient element (70) comprises a spring clip mounted at the end of a carrier (14,15) securable to and forming at least one of the upper and lower frame member (12,13), said spring clip having a portion (72) which is pushed away as the body (40) is moved towards the side frame member (10) and springs back to hold the body in engagement with side frame member (10).

25. A slat tilting mechanism unit for use in mounting a venetian blind between two panes of glass (16,17) of a multiple glazed window, in which the blind comprises an upper elongated supporting member (31) extending across all or part of the width of the blind, means (25) for pivotally mounting the supporting member about its longitudinal axis, slat supporting means (33) extending from said upper supporting member (31) and a pluraity of slats (34) carried by said supporting means (33), said slat tilting mechanism unit being characterized in that it is separte from the blind and includes an elongate body (40) a bearing (46) on said body (40), adjacent one end of the body, a rotatable drive member (53) mounted in said bearing (46), an operating member (64–67) linearly movable longitudinally of said body under magnetic effect by a linearly movable actuating member (69) mounted externally of the multiple glazed window, a drive element (61) connected between said operating member and said rotatable drive member (53), whereby linear movement of said operating member (64–67) will cause simultaneous rotation of said drive member (53) in the same rotational sense, a connection (57,58) on said rotatable drive member (53) drivingly connectable, to one end of the upper elongate supporting member (31).

26. A slat tilting mechanism unit for use in mounting a venetian blind within an opening to be covered thereby in which the blind comprises an upper elongate supporting member (31) extending across all or part of the width of blind, means (25) for pivotablly mounting the supporting member about its longitudinal axis, slat supporting means (33) extending from said upper supporting member (31) and a plurality of slats (34) carried by said supporting means (33), said slat tilting mechanism unit being characterised in that it is separate from the blind and includes an elongate body (40) securable against an inner surface of a side frame member of the opening to be covered by holding means (70), a bearing (46) on said body (40), adjacent one end of the body, a rotatable drive member (53) mounted in said bearing (46), an operating member (64–67) linearly movable longitudinally of said body by a linearly movable actuating member (69), a drive element (61) connected between said operating member and said rotatable drive member (53), whereby linear movement of said operating member (64–67) will cause simultaneous rotation of said drive member (53) in the same rotational sense, a connection (57, 58) on said rotatable drive member (53) drivingly connectable, to one end of the upper elongate supporting member (31).

* * * * *